US010874210B1

(12) United States Patent
Visbeen et al.

(10) Patent No.: US 10,874,210 B1
(45) Date of Patent: Dec. 29, 2020

(54) MODULAR CLOSET DOOR AND HINGE SYSTEM

(71) Applicant: Visbeen Architects, Inc., East Grand Rapids, MI (US)

(72) Inventors: Wayne Visbeen, East Grand Rapids, MI (US); Daniel J. Schollaart, Hudsonville, MI (US)

(73) Assignee: Visbeen Architects, Inc., East Grand Rapids, MI (US)

( * ) Notice: Subject to any disclaimer, the term of this patent is extended or adjusted under 35 U.S.C. 154(b) by 0 days.

(21) Appl. No.: 16/161,199

(22) Filed: Oct. 16, 2018

Related U.S. Application Data

(60) Provisional application No. 62/572,743, filed on Oct. 16, 2017.

(51) Int. Cl.

| | |
|---|---|
| ***A47B 61/00*** | (2006.01) |
| ***A47B 83/04*** | (2006.01) |
| ***E06B 7/28*** | (2006.01) |
| ***E05D 7/00*** | (2006.01) |
| ***E05D 5/02*** | (2006.01) |
| ***E05D 3/02*** | (2006.01) |

(52) U.S. Cl.
CPC ..... *A47B 61/003* (2013.01); *A47B 83/045* (2013.01); *E05D 3/02* (2013.01); *E05D 5/02* (2013.01); *E05D 7/00* (2013.01); *E06B 7/28* (2013.01); *E05Y 2900/132* (2013.01)

(58) Field of Classification Search
CPC ..... A47B 61/003; A47B 83/045; E05D 7/00; E05D 5/02; E05D 3/02; E06B 7/28; E05Y 2900/132
See application file for complete search history.

(56) References Cited

U.S. PATENT DOCUMENTS

| | | | | |
|---|---|---|---|---|
| 2,200,934 A | | 5/1940 | Platt et al. | |
| 3,662,493 A | * | 5/1972 | Foltz | E05D 7/0027 49/388 |
| 3,895,413 A | * | 7/1975 | Buergers | E05D 5/02 16/382 |
| 4,219,248 A | * | 8/1980 | Goldberg | A47B 49/004 108/142 |
| 5,752,756 A | * | 5/1998 | Compagnucci | A47B 49/004 312/238 |

(Continued)

*Primary Examiner* — Basil S Katcheves
*Assistant Examiner* — Omar F Hijaz
(74) *Attorney, Agent, or Firm* — Gardner, Linn, Burkhart & Ondersma LLP

(57) ABSTRACT

A closet assembly includes a fixed portion that is configured to be disposed at a closet opening and an operable door portion that is configured to move relative to the fixed portion between a closed position and an open position. A hinge assembly is configured to attach between the operable door portion and the structural opening, such that the operable door portion moves via the hinge assembly. The hinge assembly includes an upper base bracket and a lower base bracket that each have a plate portion and a cylindrical projection extending substantially orthogonal from a planar extent of the plate portion. The hinge assembly also includes a door bracket that has a vertical member extending between upper and lower horizontal members. The upper and lower horizontal members are pivotally coupled with the cylindrical projections of the respective upper and lower base brackets.

9 Claims, 15 Drawing Sheets

(56) References Cited

U.S. PATENT DOCUMENTS

| | | | | |
|---|---|---|---|---|
| 6,164,610 | A * | 12/2000 | Santiago | A47B 96/022 211/90.01 |
| 6,457,278 | B1 | 10/2002 | Fleming | |
| 6,634,727 | B2 | 10/2003 | Torres | |
| 2004/0045222 | A1* | 3/2004 | Hicks | E05F 1/066 49/394 |
| 2009/0224119 | A1* | 9/2009 | Heffernan | A47B 96/066 248/225.11 |
| 2010/0319262 | A1* | 12/2010 | Stull | E05F 15/614 49/348 |
| 2012/0011775 | A1* | 1/2012 | Chen | E05B 47/004 49/358 |
| 2016/0024827 | A1* | 1/2016 | Lambright | E06B 3/36 49/386 |
| 2017/0044811 | A1* | 2/2017 | Tsou | E06B 3/70 |
| 2017/0350185 | A1* | 12/2017 | Kuan | E06B 3/48 |

* cited by examiner

MODULAR CLOSET DOOR AND HINGE SYSTEM

CROSS REFERENCE TO RELATED APPLICATION

This application claims the filing benefits of U.S. provisional application, Ser. No. 62/572,743, filed Oct. 16, 2017, which is hereby incorporated herein by reference in its entirety.

FIELD OF THE INVENTION

The present invention relates generally to closets and other enclosable storage areas of a building, and more particularly to closet door arrangements and associated hinge systems.

BACKGROUND OF THE INVENTION

Typically, closets are enclosable by a door, such as single or double-hung doors or accordion doors or the like. These common closet doors are generally hollow or solid core doors made of one or more panels, where the sole purpose and function of such doors is enclosing or concealing the closet space from the room or hall or area that leads to the closet.

SUMMARY OF THE INVENTION

The present invention provides a closet assembly and an associated hinge assembly for a closet door. The closet assembly provides fixed and operable closet door portions that are selectively arranged in the closet and/or at the closet door to provide optimized and increased closet capacity of the closet area. The operable door portion of the closet assembly is configured to swing or pivot relative to the fixed portion of the closet assembly disposed at the closet opening, so as to generally conceal the closet opening and store the operable door portion at or substantially in the closet opening when in the closed position. The operable door portion may include a door module, such as, for example, a shelf module, a clothing hanger module, or a wet bar module or the like. The functional or accessible side of the door module may be arranged inward or outward in the closed position depending on the desired function of the closet area. The hinge assembly of the closet door provides the structural support and smooth pivotal capability to these door modules and also a structural design that allows for the ease of installation of the door modules.

In accordance with one aspect of the present invention, a closet assembly includes a fixed portion configured to be disposed at a structural opening of a closet disposed within a wall. An operable door portion is configured to move relative to the fixed portion between a closed position and an open position. A hinge assembly is disposed between the operable door portion and the structural opening. The operable door portion moves via the hinge assembly. The hinge assembly includes an upper base bracket and a lower base bracket, each having a plate portion and a cylindrical projection extending substantially orthogonal from a planar extent of the plate portion. The hinge assembly also includes a door bracket including upper and lower horizontal members and a vertical member extending between the upper and lower horizontal members. The upper and lower horizontal members are pivotally coupled with the cylindrical projections of the respective upper and lower base brackets.

In accordance with another aspect of the present invention, a hinge assembly for a closet door includes upper and lower base brackets that are configured to be secured at respective upper and lower portions of a structural opening of the closet door. A door bracket includes upper and lower members arranged generally horizontally, and also includes an upright member that extends and couples between the upper and lower members of the door bracket. The upper and lower base brackets each comprise a plate portion and an engagement portion disposed at the plate portion. The upper and lower horizontal members are pivotally coupled with the engagement portions of the respective upper and lower base brackets for the door bracket to pivot relative to the upper and lower base brackets. Thus, the upper and lower horizontal members may be configured to receive any one of a plurality of closet door modules.

In accordance with yet another aspect of the present invention, a method includes attaching an upper base bracket and a lower base bracket at respective upper and lower portions of a closet opening. The upper and lower base brackets each include a plate portion arranged generally horizontally, and further includes an engagement portion disposed at the plate portion. A lower horizontal member of a door bracket is engaged with the engagement portion of the lower base bracket. The door bracket includes a vertical member that extends between an upper horizontal member and the lower horizontal member. A support post is inserted upward through the upper horizontal member to pivotally couple with the engagement portion of the upper base bracket, thereby causing the upper and lower horizontal members to be pivotally coupled with the respective upper and lower base brackets. A closet door module may then engage with the upper and lower horizontal members of the door bracket to provide an operable door portion that is configured to pivot relative to the closet opening.

These and other objects, advantages, purposes and features of the present invention will become apparent upon review of the following specification in conjunction with the drawings.

DESCRIPTION OF THE PREFERRED EMBODIMENTS

Figure 17:
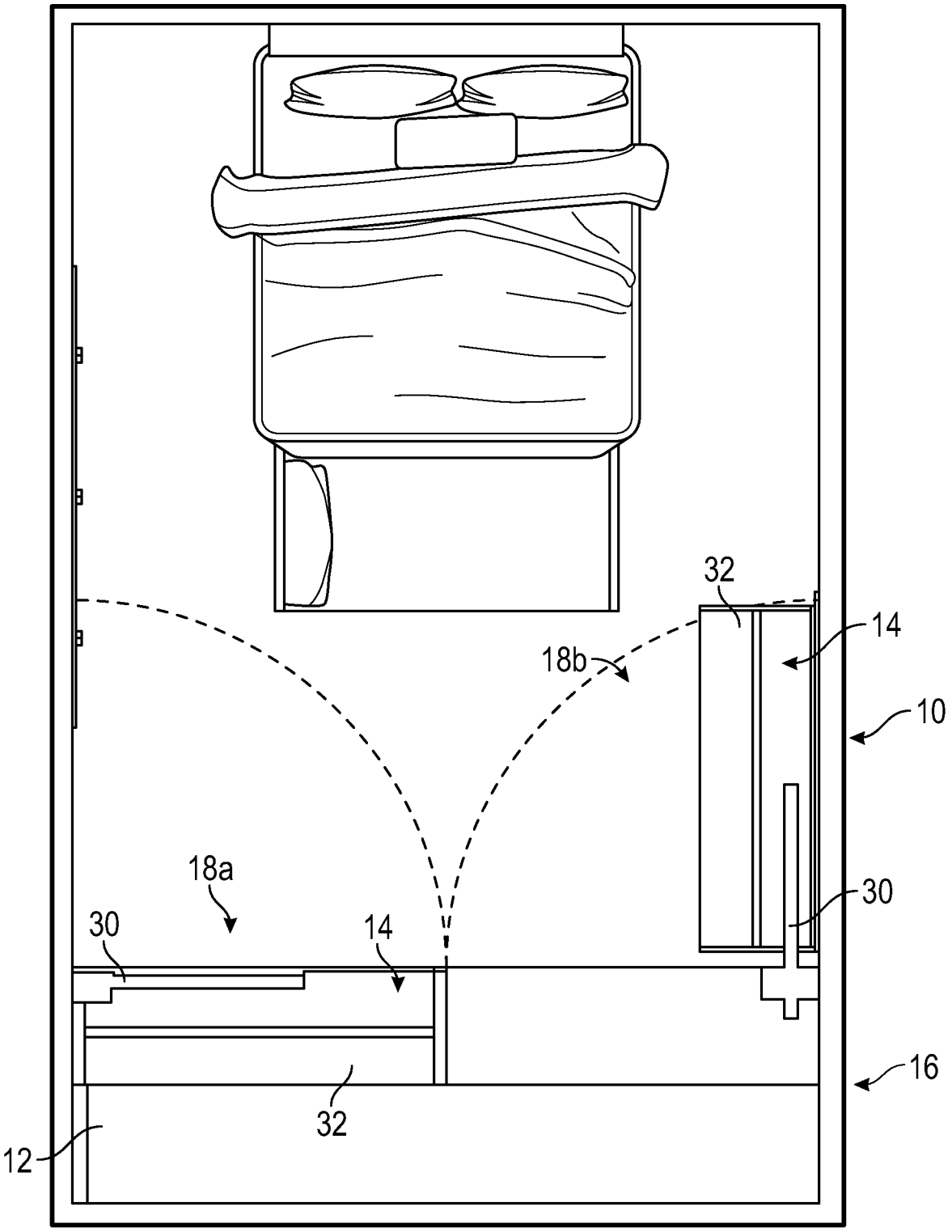
FIG. 17 is a top plan view of a bedroom incorporating a closet door assembly in accordance with the present invention.

Referring now to the drawings and the illustrative embodiments depicted therein, a closet assembly 10 includes a fixed portion 12 and an operable door portion 14 (see FIGS. 1-3) that are together arranged at and/or in a closet or portion thereof. The fixed portion 12 of the closet assembly 10 is disposed at or near a closet opening 16 (see FIG. 17), which may be a framed space built into or adjacent to an interior or exterior wall of a building or other structure. The fixed portion 12 may also generally include the interior of a closet space, such as a finished reach-in or walk-in closet or pantry or other enclosed storage space or the like. The operable door portion 14 is configured to move relative to the fixed portion 12, such as to swing or pivot between a closed position 18*a* and an open position 18*b* (FIG. 17). The operable door portion 14 may include functional features, such as storage shelves, cabinets, appliances, work surfaces, or the like, at the exterior and/or interior sides 44, 46 that are generally accessible in the respective close and open positions 18*a*, 18*b*, such as to increase the utility of the closet area (see FIGS. 4, 5, & 8).

Figure 9:
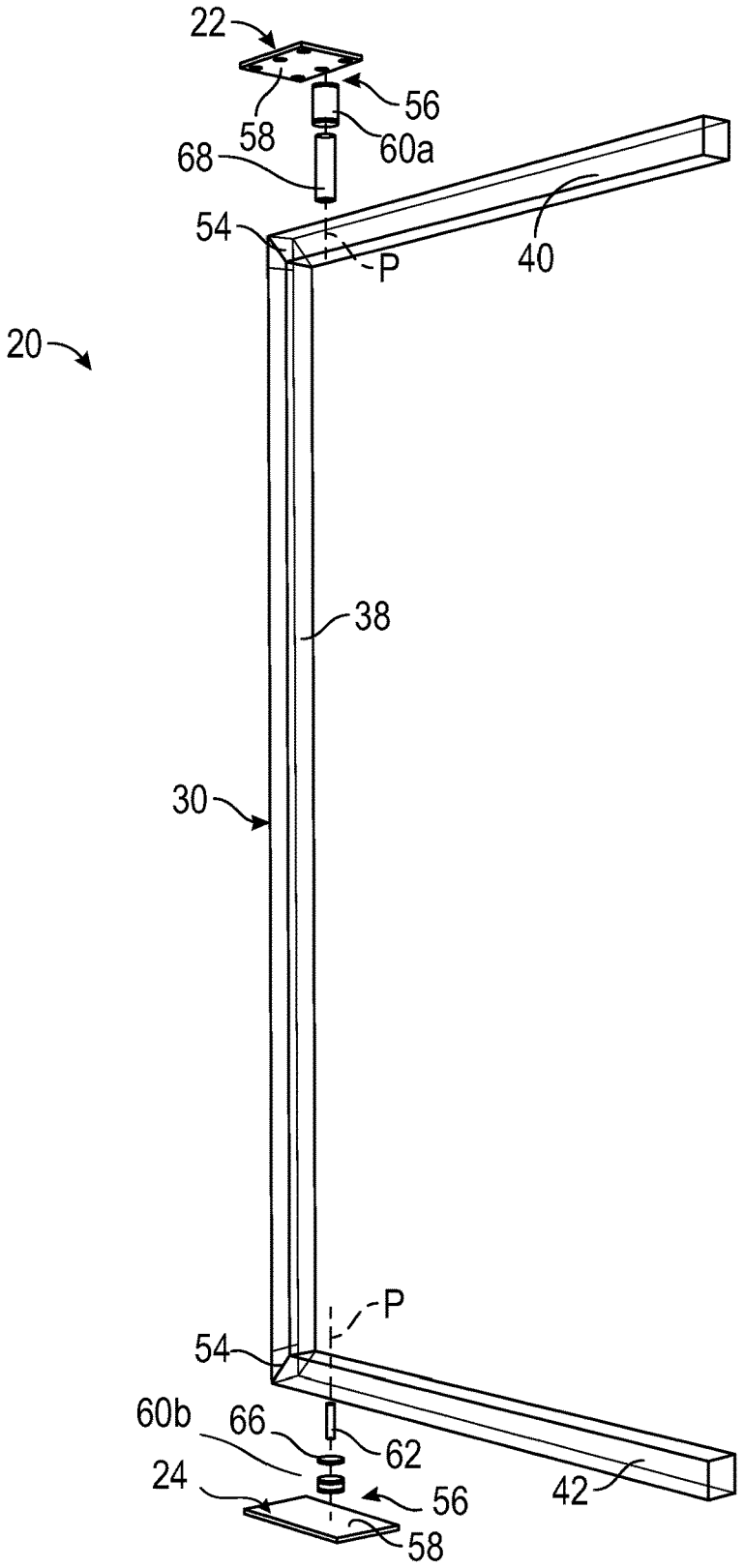
FIG. 9 is an exploded view of a hinge bracket assembly of an operable door portion of a closet door assembly.
Figure 18:
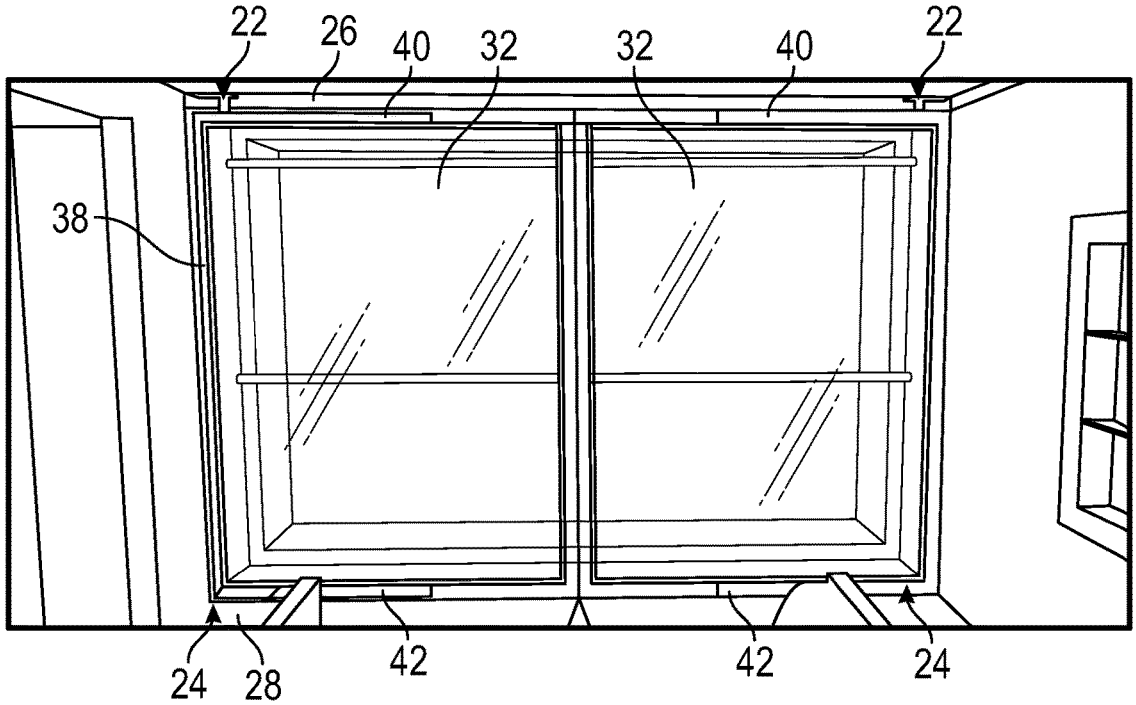
FIG. 18 is a front perspective view of the closet door assembly shown in FIG. 17.

A hinge assembly 20 is configured to attach between the operable door portion 14 and the structural opening 16, where the operable door portion 14 moves relative to the fixed portion 16 via the hinge assembly 20. The hinge assembly 20, such as shown in FIG. 9, may include an upper base bracket 22 and a lower base bracket 24 that are attached respectively to an upper portion of the closet opening 16, such as a header beam or truss or ceiling section 26, and a lower portion of the closet opening 16, such as a lower wall or floor section 28 (FIG. 18). The hinge assembly 20 may also include a door bracket 30 that is pivotally attached or coupled between the upper and lower base brackets 22, 24 and may reinforce or support the operable door portion 14, such as a door module 32 engaged with the door bracket 30 (FIG. 17), and any additional items stored or hung at the operable door portion 14. The door bracket 30 may be configured to receive any one of a plurality of different closet door modules, as illustrated and further discussed below.

Figure 1:
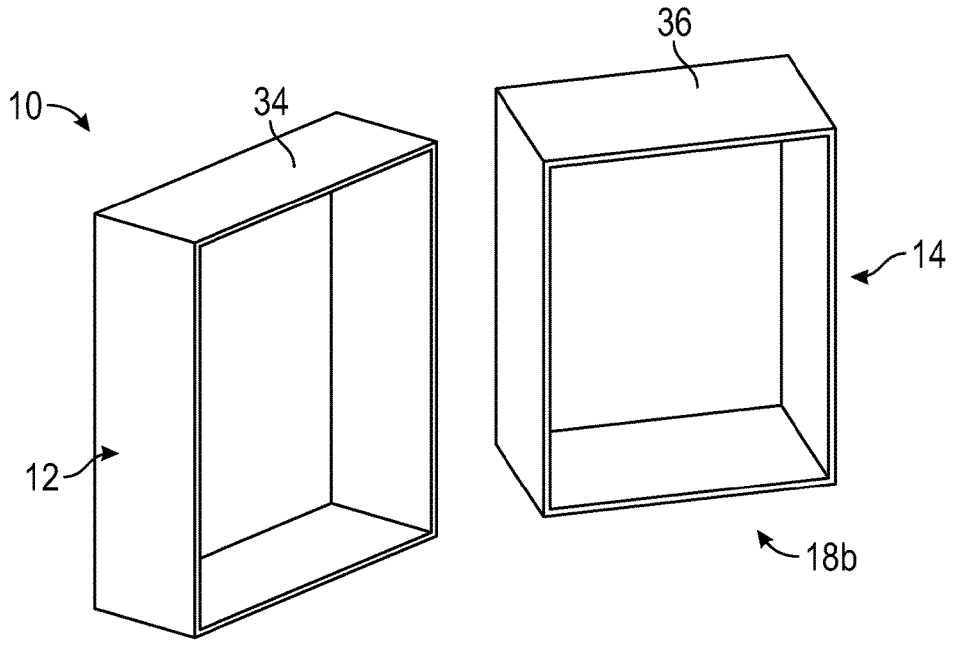
FIG. 1 is a perspective view of a closet door assembly having an operable door portion moved to an open position in accordance with the present invention.
Figure 2:
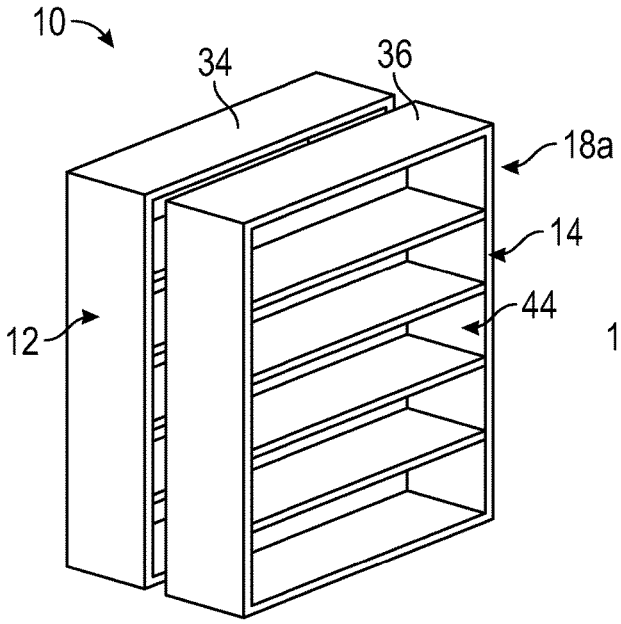
FIG. 2 is a perspective view of the closet door assembly of FIG. 1, with shelves added, and having the operable door portion in a closed position in accordance with the present invention.
Figure 3:
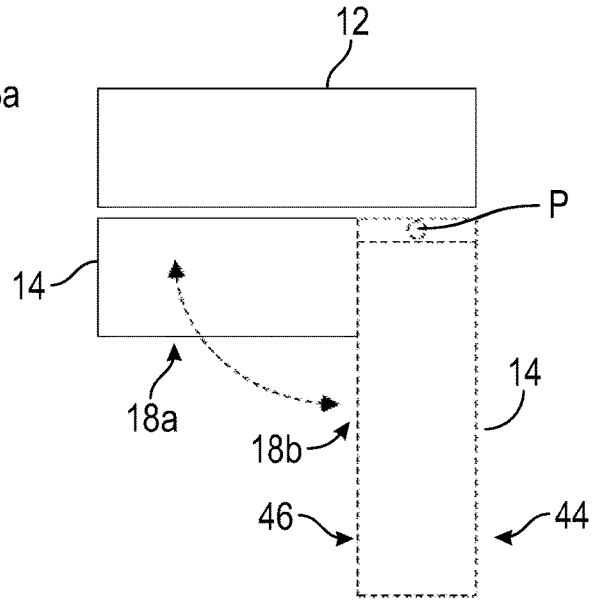
FIG. 3 is a top plan view of the closet door assembly of FIG. 1, showing the operable door portion movable relative to a fixed portion in accordance with the present invention.
Figure 4:
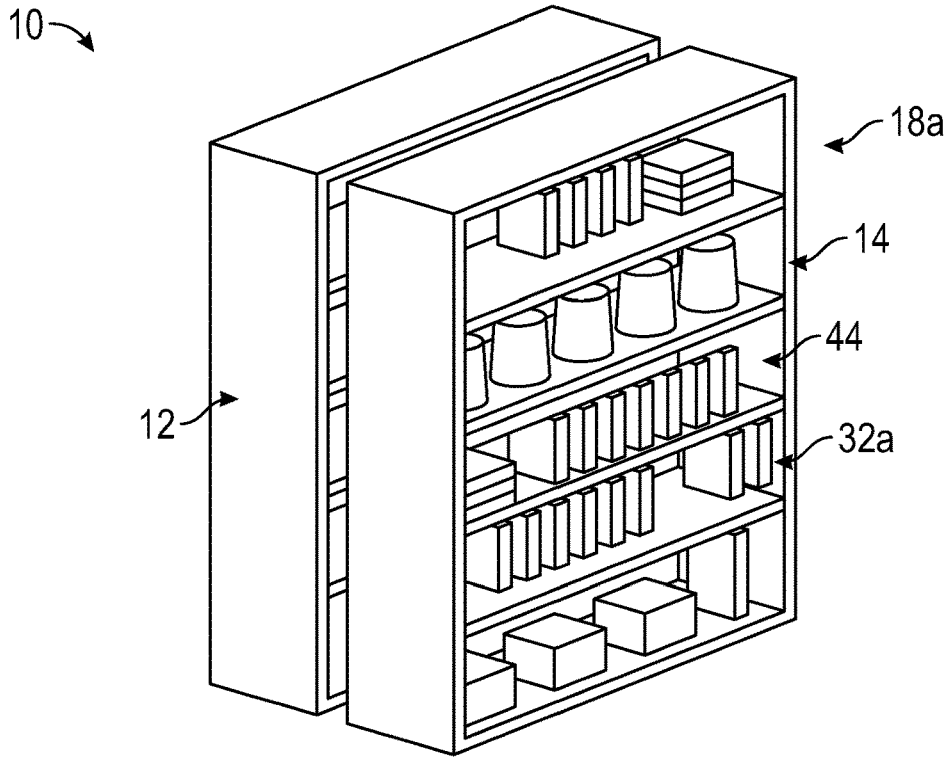
FIG. 4 is a perspective view of an additional embodiment of a closet door assembly having an operable door portion in a closed position in accordance with the present invention.

The operable door portion 14 of the closet assembly 10, as shown in FIGS. 1-5, swings or pivots about pivot point P (FIG. 3) relative to the fixed portion 12, so as to generally conceal or enclose the closet opening 16 and store the operable door portion 14 or a portion thereof in the closet space or opening 16 in the closed position 18*a* (FIG. 17). Thus, when in the closed position 18*a*, because the surface of the exterior side 44 of the operable door portion 14 is generally flush with the surrounding molding or wall sections, the exterior side 44 of the operable door portion 14 may visually appear from a viewpoint outside the closet as a feature of, or an integral portion of, a surrounding wall. As illustrated in FIGS. 1 and 2, the fixed portion 12 may include a generally rectangular outer frame 34 with substantially similar or identical dimensions to a generally rectangular shape of the outer frame 36 of the door module 32 of the operable door portion 14. It is contemplated that the fixed portion 12 may be integrated with or formed as part of the wall or surrounding building structure, such as in reach-in or walk-in closet embodiments. It is further understood that the shape of the outer frames or profile of the fixed and operable portions may vary from each other and/or may vary from a rectangular shape, such as to provide the desired visual appearance and function.

The operable door portion 14 is supported by the hinge assembly 20 so as to allow the door portion 14 to swing or pivot to expose the interior fixed portion 12 of the closet. For example, as shown in FIG. 9, the hinge assembly 20 includes the door bracket 30 that provides the necessary structural reinforcement for a large closet door as well as a structural design that allows for the ease of installation of a door module 32. The door bracket 30 may have an upright or vertical member 38 that extends generally vertically the height of the closet opening 16. The vertical member 38 may extend between and attaches at the upper and lower members 40, 42 of the door bracket 30, such as via welding, adhesive, and/or fasteners or the like. The upper and lower members 40, 42 of the door bracket 30 may be generally horizontally arranged and pivotally coupled with the respective upper and lower base brackets 22, 24 at substantially the same pivot point P. The illustrated door bracket 30 is, thus, shown as with a U shape rotated ninety degrees and having square corners. It is also understood that the door bracket may alternatively have an "I" shape, an "E" shape, or a rectangular shaped frame, among various conceivable shapes and configurations.

The door bracket 30 is shown comprising hollow metal beam sections with square cross-sectional profiles that are welded together at mitered corners. However, the door bracket may comprise a plastic, composite material, wood, and/or metal, such as aluminum or steel, and may also be formed from a single piece of material such that the upper and lower members are a single integrally formed piece together with the vertical member. Further, if assembled with separate sections or members, the sections may be reinforced with support brackets and/or attached together in various ways, such as via welding, adhesive, and/or fasteners, and/or other conceivable means of attachment.

Figure 6:
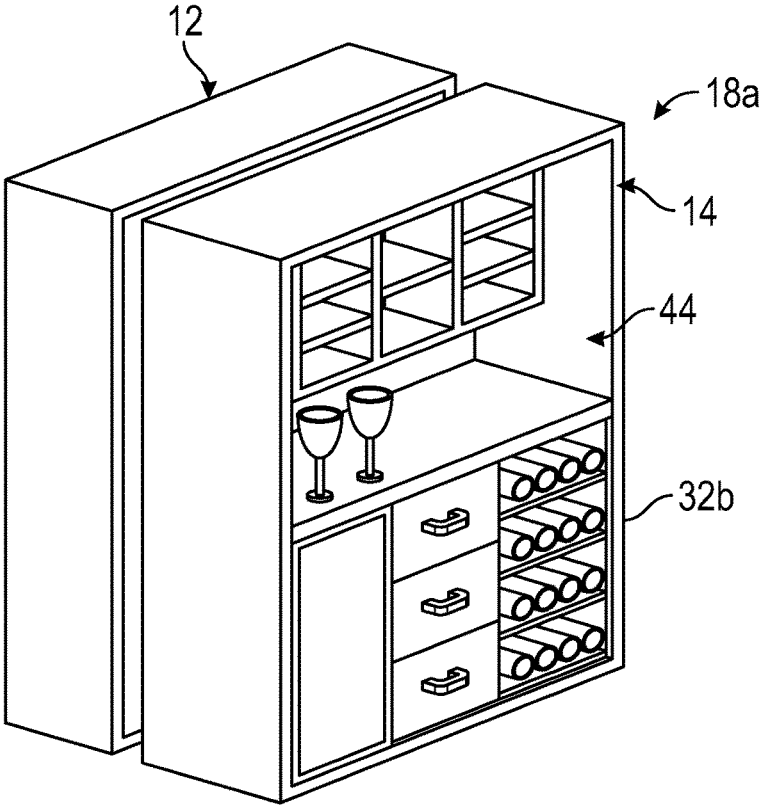
FIG. 6 is a perspective view of an additional embodiment of a closet door assembly having a wet bar cabinet arrangement at the operable door portion in accordance with the present invention.
Figure 7:
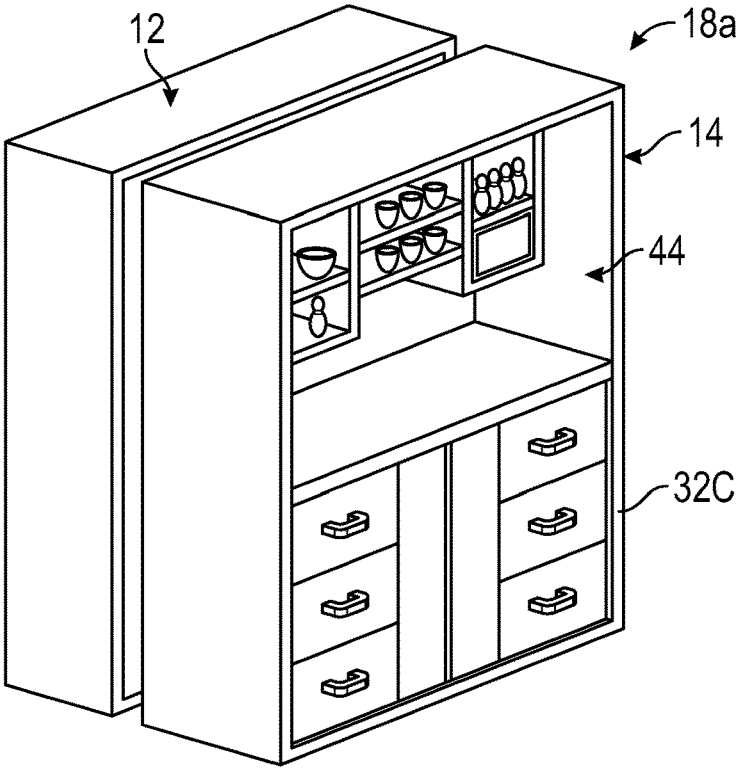
FIG. 7 is a perspective view of an additional embodiment of a closet door assembly having an additional cabinet arrangement at the operable door portion in accordance with the present invention.
Figure 19:
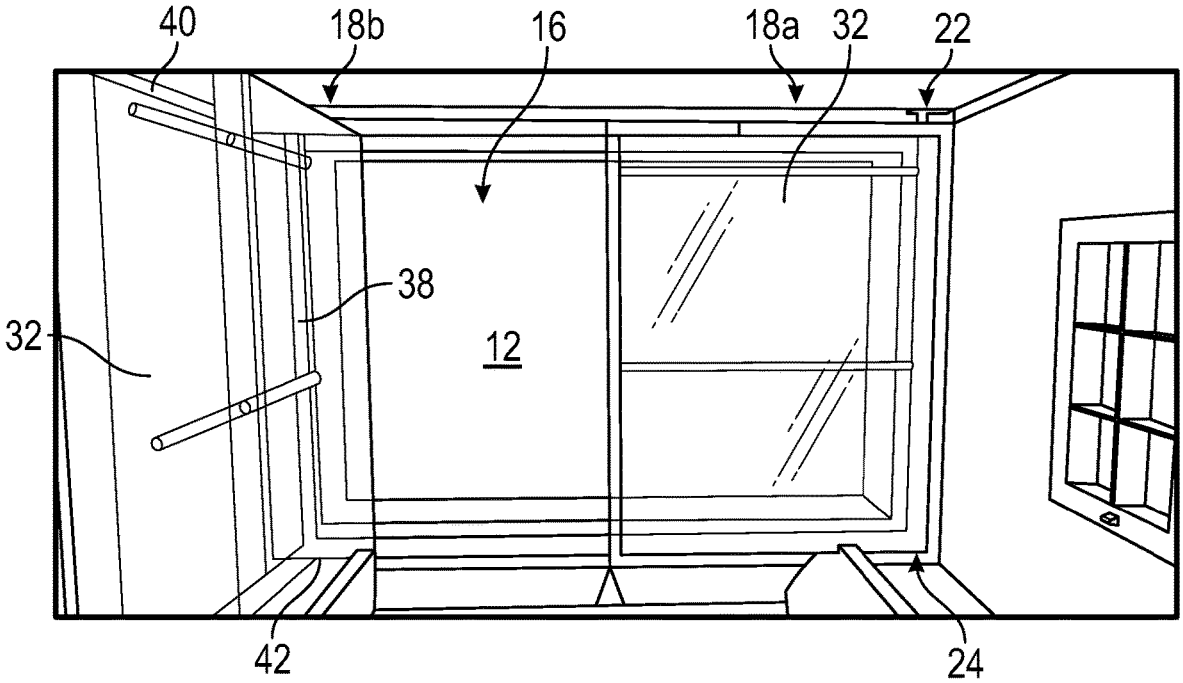
FIG. 19 is a front perspective view of the closet door assembly shown in FIG. 18 with the operable door portion moved to the open position.
Figure 24:
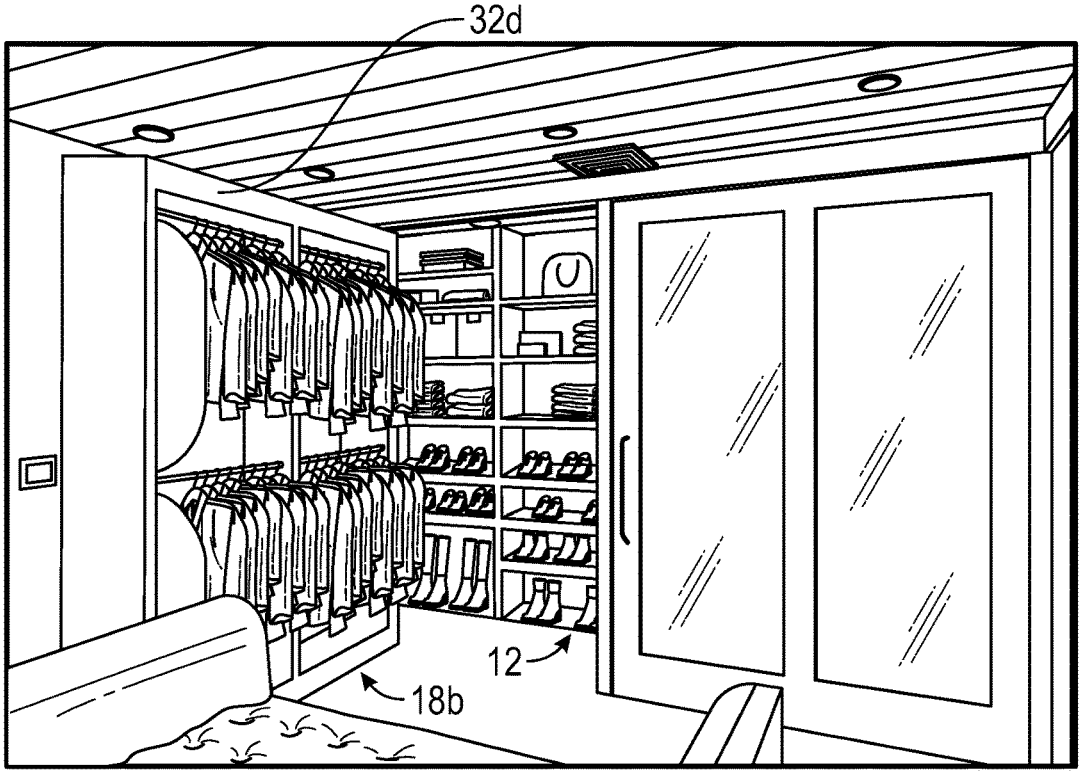
FIG. 24 is a front perspective view of the closet door assembly shown in FIG. 23 with one of the operable door portions moved to the open position.
Figure 25:
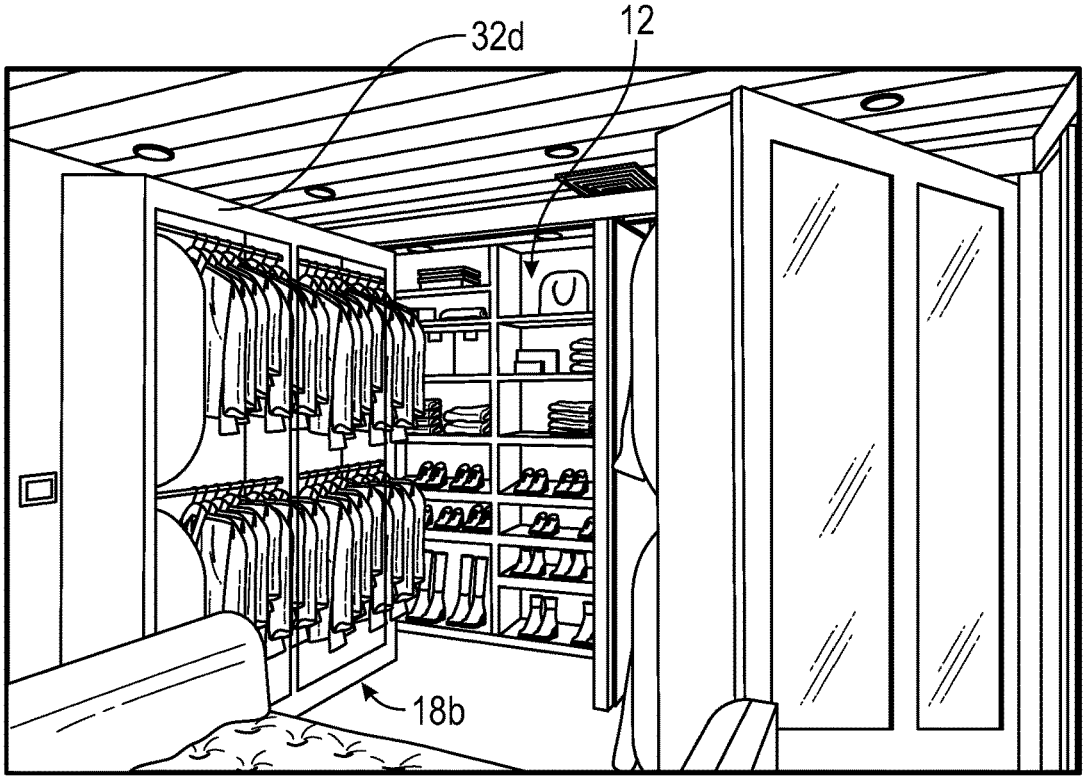
FIG. 25 is a front perspective view of the closet door assembly shown in FIG. 23 with both of the operable door portions moved toward the open positions.
Figure 26:
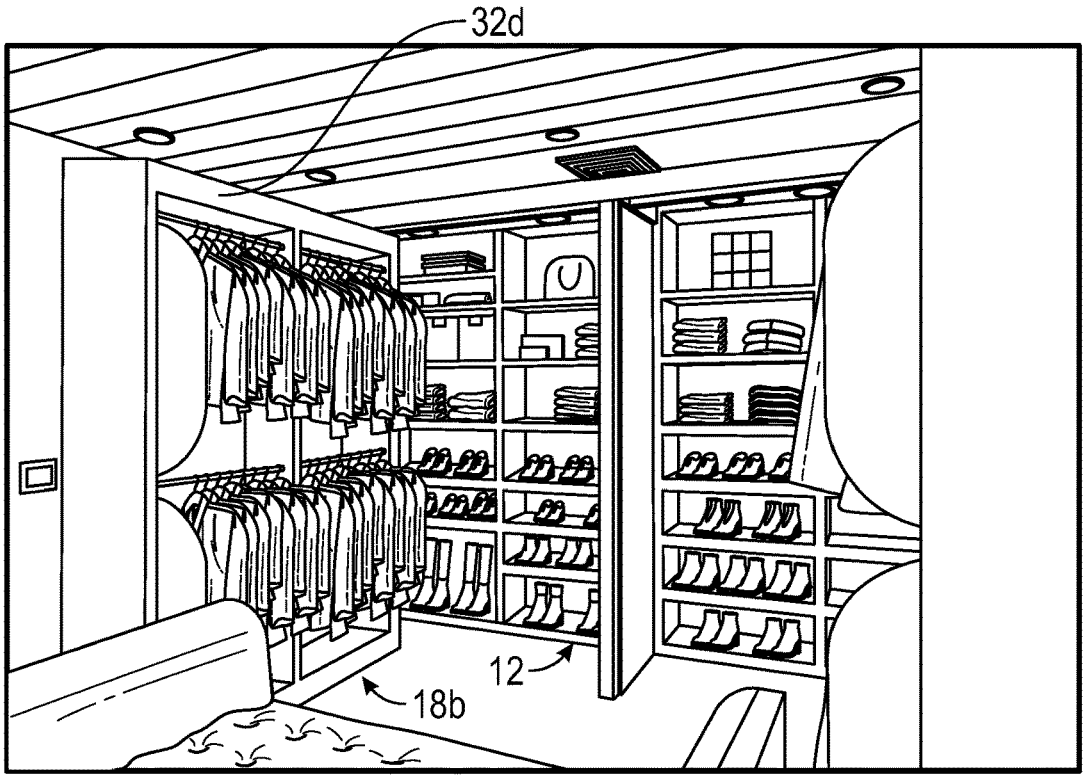
FIG. 26 is a front perspective view of the closet door assembly shown in FIG. 23 with both of the operable door portions moved to the open positions.
Figure 27:
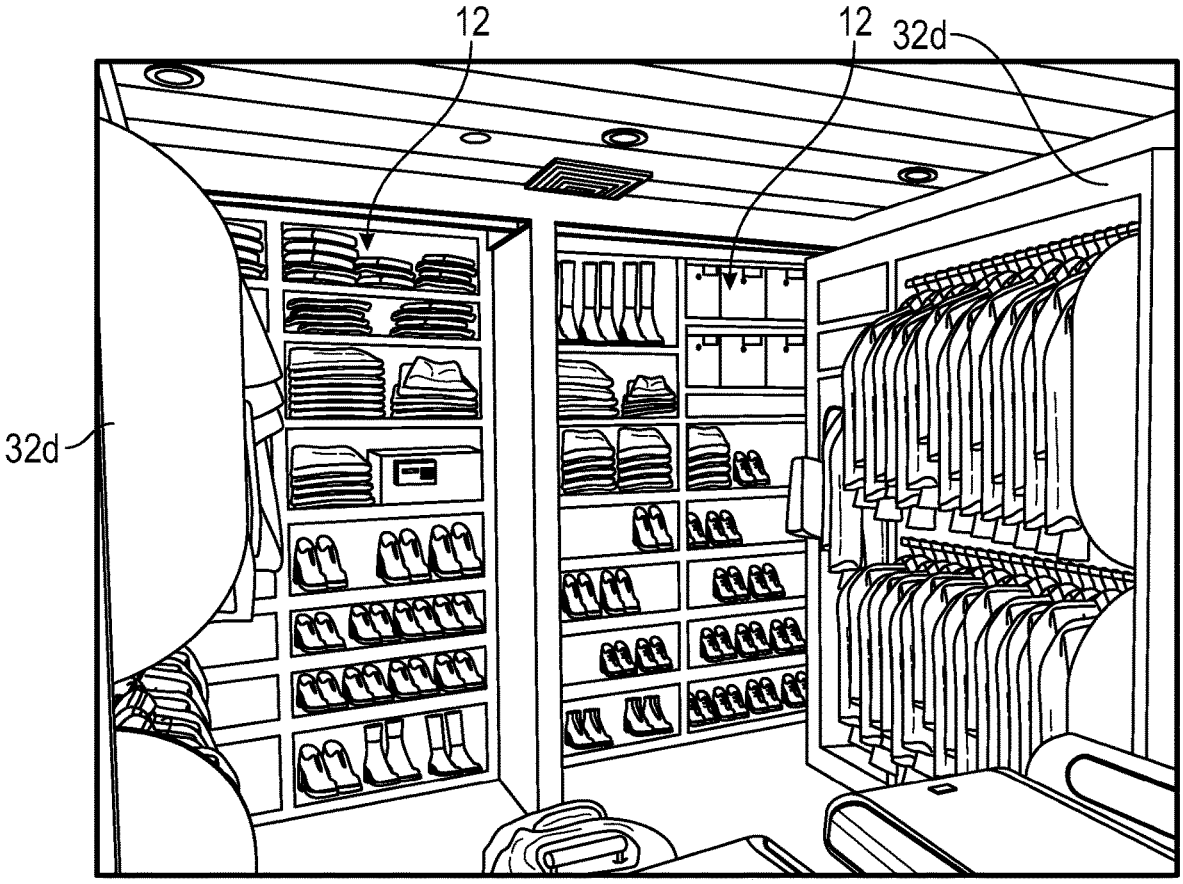
FIG. 27 is an additional perspective view of the closet door assembly shown in FIG. 26.

The upper and lower horizontal members 40, 42 of the door bracket 30 may be configured to receive any one of a plurality of different closet door modules, such as by inserting the upper and lower horizontal members 40, 42 into respective upper and lower channels of a door module 32 (FIGS. 17-19). The door module 32 may engage along the inside surfaces of the U-shaped door bracket 30, such that the door module 32 is supported within the U-shaped frame of the door bracket 30. The "U" shape of the illustrated door bracket 30 generally does not interfere with the configurable space for door module 32, so as to allow various types and configurations of door modules to be attached to the door bracket 30. Accordingly, the operable door portion 14 may be configured with various different closet door modules, such as a shelf module 32*a* (FIG. 4), a wet bar module 32*b* (FIG. 6), a kitchenette module 32*c* (FIG. 7), or a clothing hanger module 32*d* (FIG. 24). Further embodiments include the incorporation of a desk module, and a wine rack module, among other conceivable door modules with cabinet, drawer, shelving, countertop, appliance, and storage feature arrangements for the desired function of the cabinet area. The door modules 32 may include an exterior side 44 that is visible and accessible from the area in front of the closet opening 16 when the operable door portion 14 is in the closed position 18*a*, so as to permit use of the exterior functional features of the door module, such as the shelves (FIG. 4), refrigerator (FIG. 6), cabinets (FIG. 7) and the like. The door modules may also include an interior side 46 that is visible and accessible from the area in front of the closet opening 16 when the operable door portion 14 is in the open position 18*b*.

Figure 5:
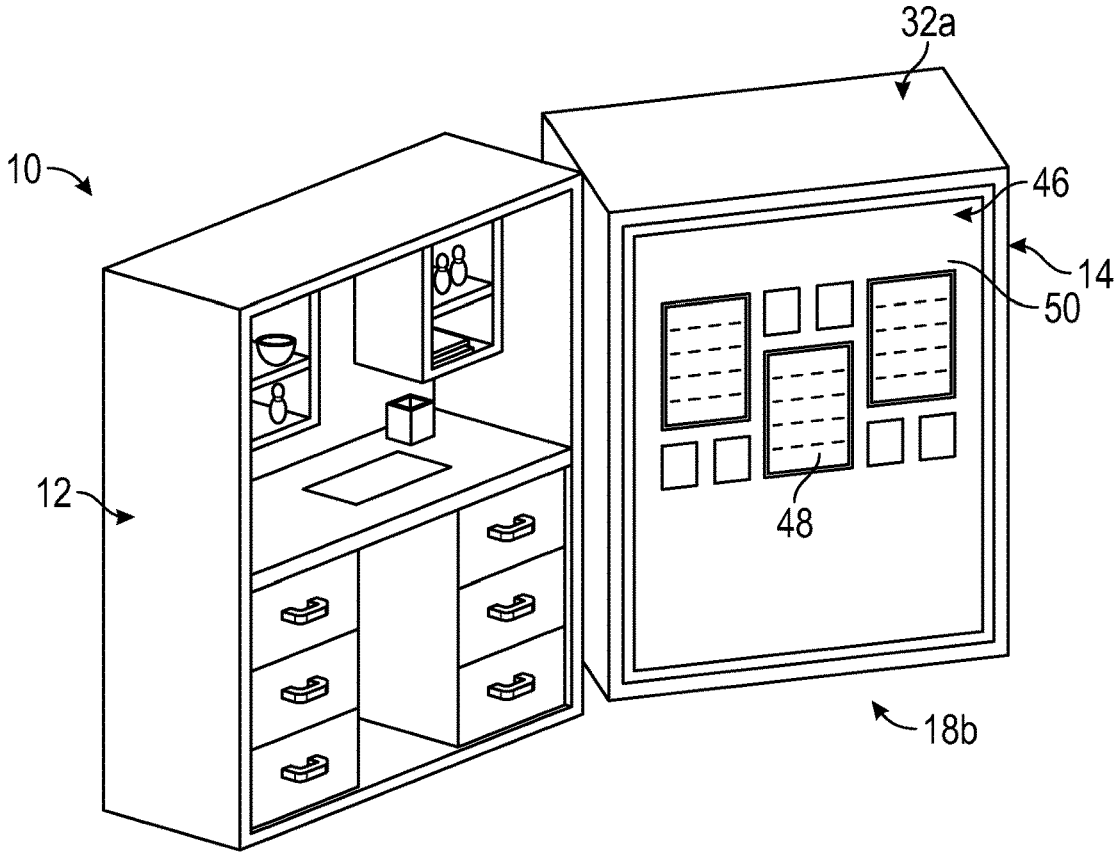
FIG. 5 is a perspective view of the closet door assembly shown in FIG. 4 having the operable door portion moved to an open position to reveal a desk at the fixed portion in accordance with the present invention.
Figure 8:
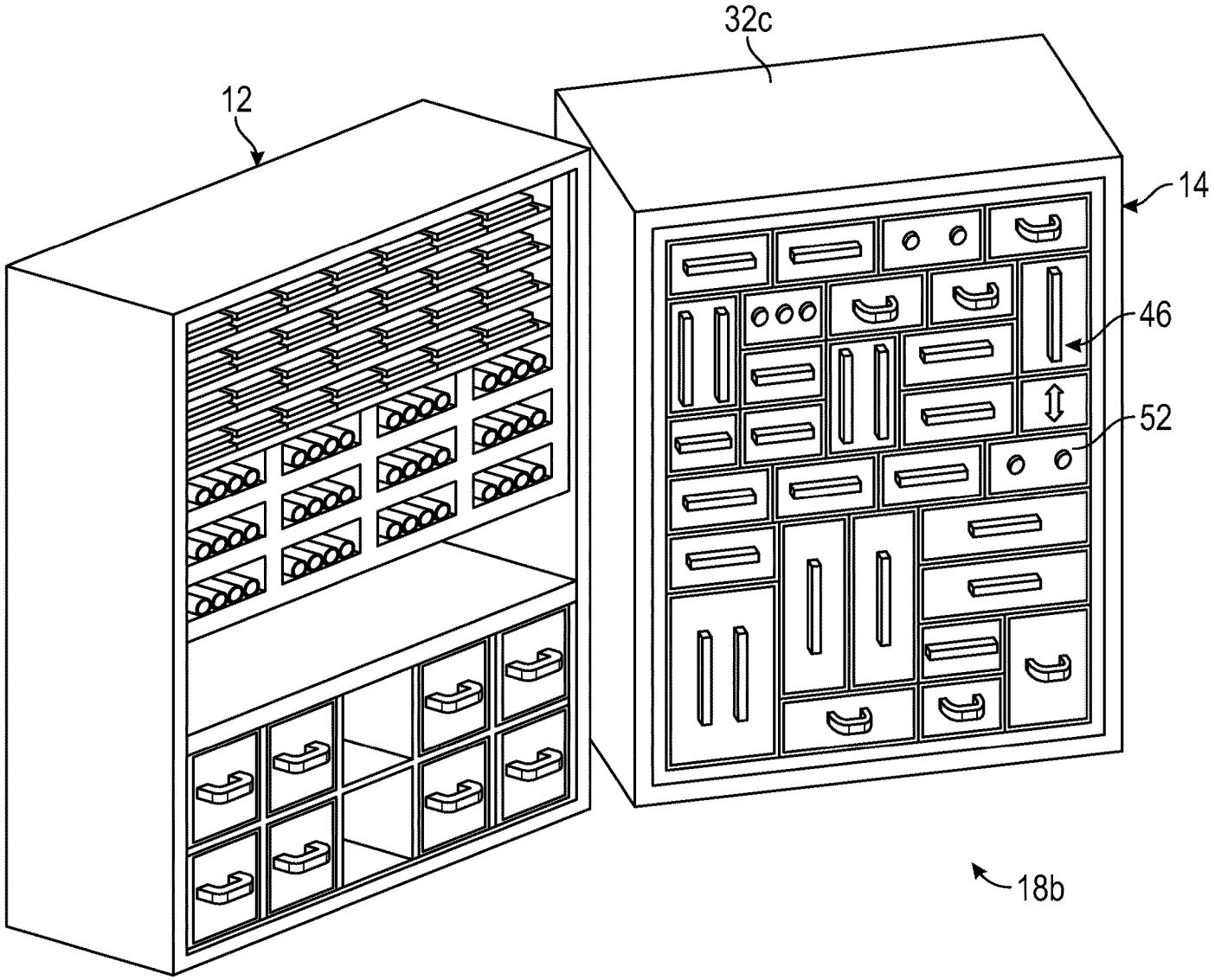
FIG. 8 is a perspective view of an additional embodiment of a closet door assembly having the operable door portion moved to an open position to reveal a wine storage cabinet arrangement at the fixed portion in accordance with the present invention.
Figure 20:
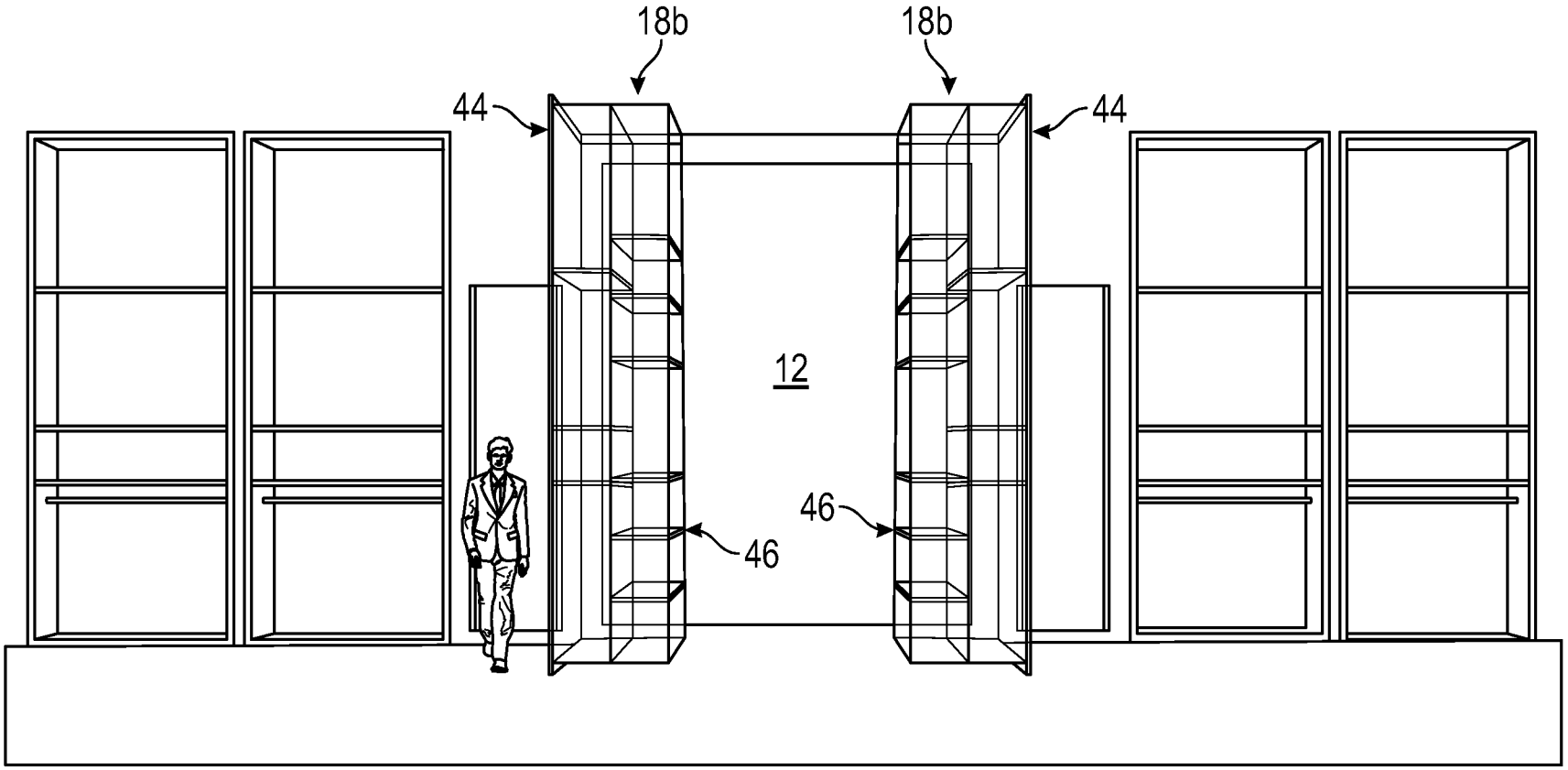
FIG. 20 is a front perspective view of an additional embodiment of a closet door assembly with two operable door portions moved to the open position in accordance with the present invention.
Figure 21:
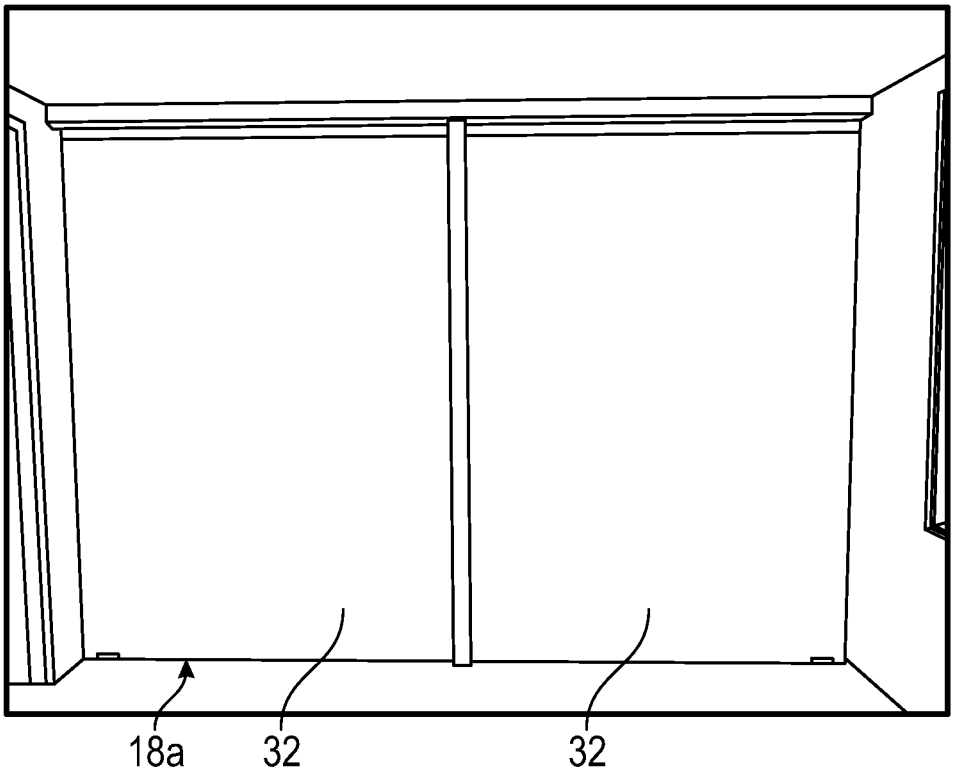
FIG. 21 is a front perspective view of a closet door assembly with the operable door portions in the closed position in accordance with the present invention.
Figure 22:
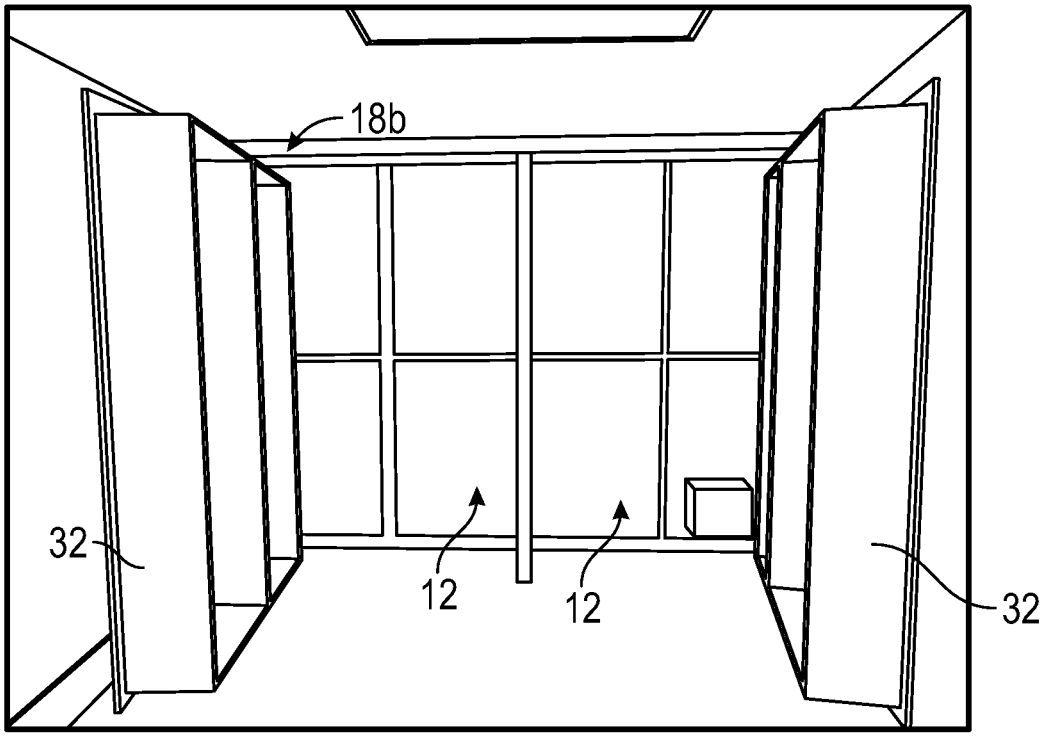
FIG. 22 is a front perspective view of the closet door assembly shown in FIG. 21 with the operable door portions moved to the open position.
Figure 23:
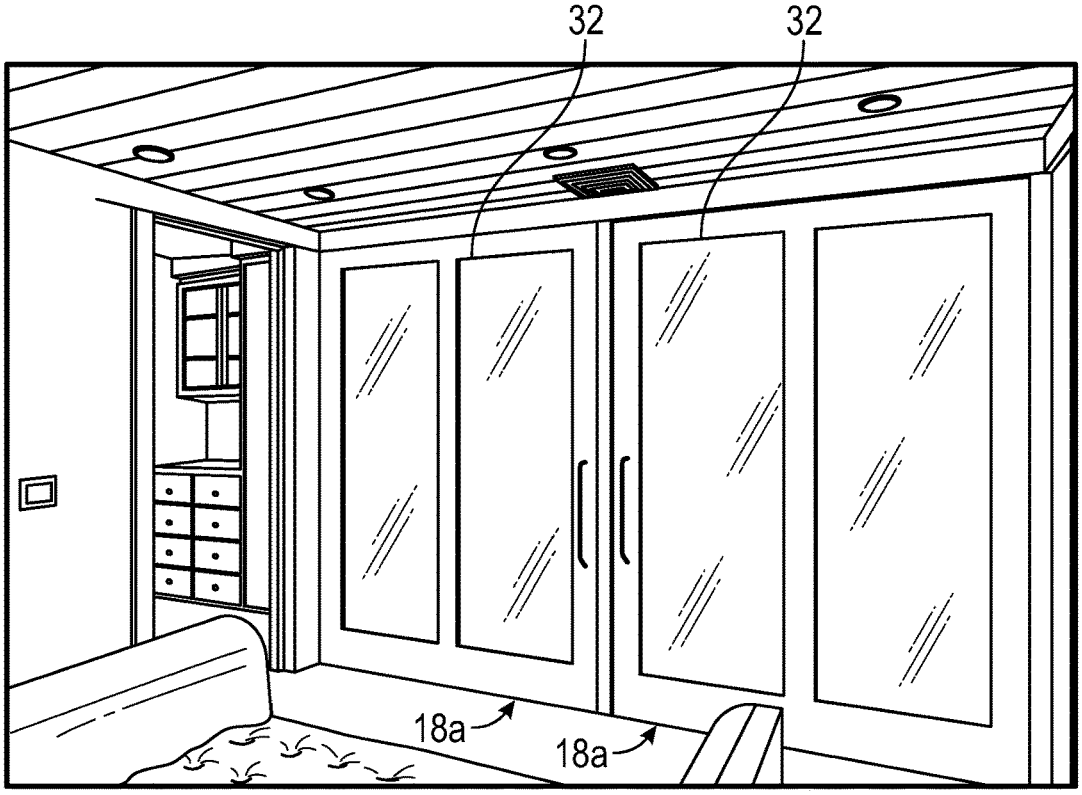
FIG. 23 is a front perspective view of a closet door assembly with the operable door portions in the closed position in accordance with the present invention.

The interior side 46 of the door module 32 may also include functional features, such as to correspond to the functional features of the exposed fixed portion 12 of the closet assembly. For example, the shelf module 32*a* shown in FIGS. 3-5 may include an interior feature at the interior side 46, such as a white board 48, cork board 50, and framed pictures to compliment the office desk arrangement disposed at the fixed portion 12 (FIG. 5). Also, for example, as shown in FIG. 8, a patterned wall mural 52 may be provided at the interior side 46 with design features that complement the wine rack arrangement disposed at the fixed portion 12 (FIG. 8). Further, the interior or exterior sides of an operable door portion 14 may include a mirror (FIG. 24) to compliment a clothing storage arrangement disposed at a fixed portion or other conceivable complimentary interior feature. Alternatively, the features disposed at the interior side 46 of the door module 32 may complement its exterior features, such as shown in FIG. 20 with additional storage shelves being provided at the interior side 46 of the door module 32, such as to allow for quick access for filing the displayed items held at the exterior storage features of the door module, such as additional clothing storage for a retail setting. As also shown in FIG. 20, the interior features may be used to expand an available retail display space, such as to allow the retail display area to be adjusted by simply moving the doors between the open and closed positons. Further, the fixed portion 12, such as shown in FIGS. 24-27, may include interior lights that are operable to turn on when the operable door portion 14 is moved to or toward the open position 18*b* and turn off when moved to or toward the closed position 18*a*.

To further provide adjustability to the closet area, the door module 32 may be reversed, such as by removing the door module 32 from the door bracket 30 of the hinge assembly 20 and turning it around for the previously oriented interior side to be disposed at the newly oriented exterior side of the door module 32 and likewise for the previously oriented exterior side to be disposed at the newly oriented interior side of the door module 32. This reversal may be done by reattaching the removed door module at the same door bracket or, in the case of two adjacent door modules, reversal may be done by reattaching the removed door module with the door bracket of the adjacent door bracket. Specifically, the door module 32 may be detached from the upper and lower horizontal members 40, 42 of the door bracket 30 by detaching any fasteners that secure the door module 32 to the door bracket 30 and sliding the door module 32 horizontally along the upper and lower horizontal members 40, 42 away from the vertical member 38 of the door bracket 30 until the door bracket 30 is completely withdrawn from the corresponding channels of the door module 32.

Figure 11:
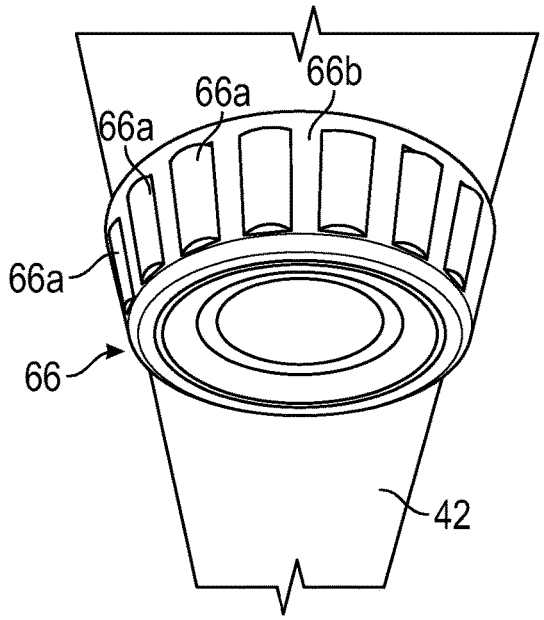
FIG. 11 is a perspective view of a roller bearing of the hinge bracket assembly of FIG. 9.
Figure 12:
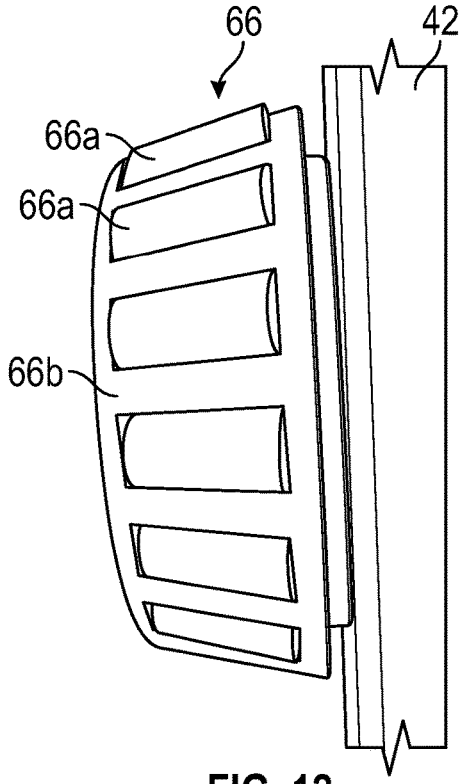
FIG. 12 is an elevational view of the roller bearing of FIG. 11.
Figure 13:
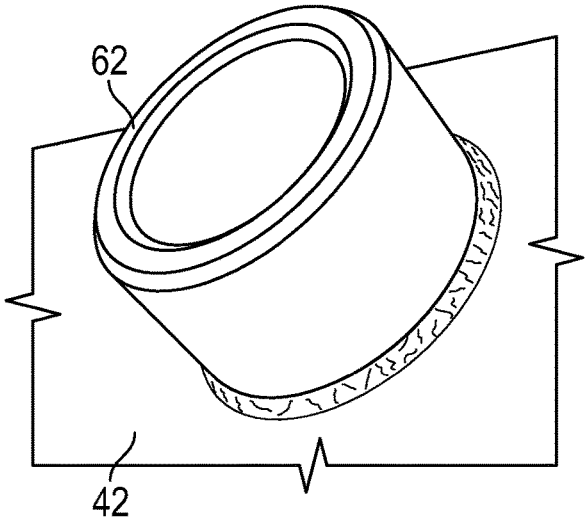
FIG. 13 is a perspective view of a lower support post of the hinge bracket assembly of FIG. 9.
Figure 14:
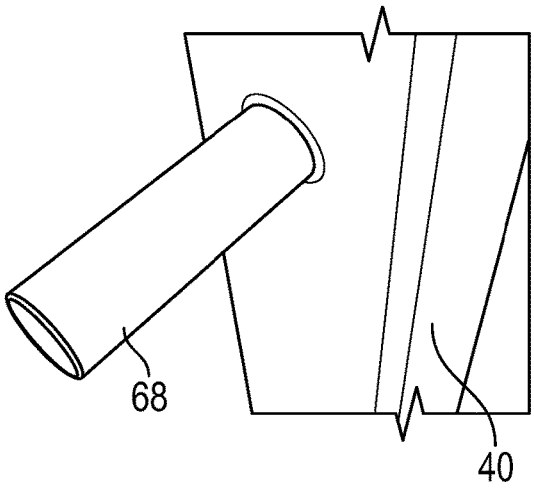
FIG. 14 is a perspective view of an upper support post of the hinge bracket assembly of FIG. 9.
Figure 15A:
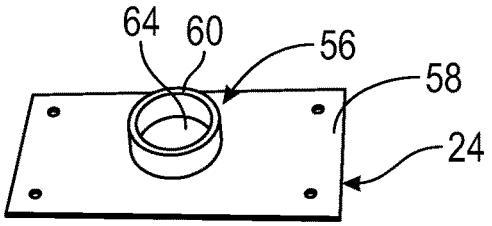
FIG. 15 is a perspective view of base brackets of the hinge bracket assembly of FIG. 9.
Figure 15B:
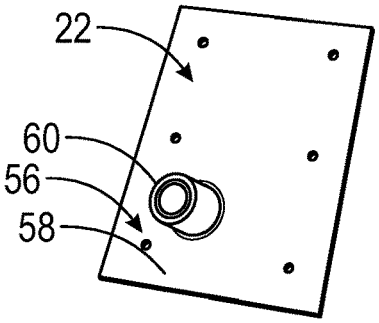
Figure 15C:
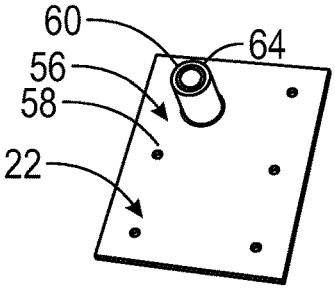
Figure 15D:
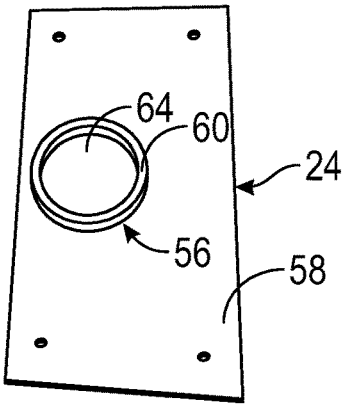
Figure 16:
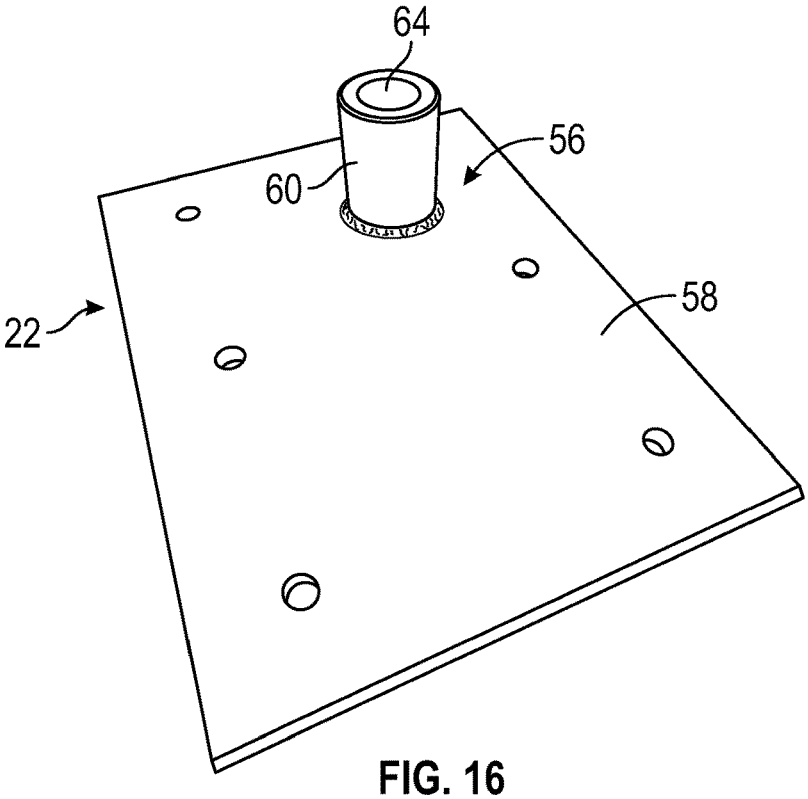
FIG. 16 is a perspective view of an upper base bracket of the hinge bracket assembly of FIG. 9.

The upper and lower horizontal members 40, 42 of the door bracket 30 are pivotal relative to the cabinet opening 16, such as shown in FIG. 9, at the pivot point P that is offset inward from the ends 54 of the horizontal members 40, 42 nearest the pivot point P. This pivot point P is offset toward the center of the door module 32 to reduce the undesirable moment forces applied to the pivotal connection. To form the pivotal connection, the upper and lower horizontal members 40, 42 each engage the respective upper and lower base brackets 22, 24 at an engagement portion 56 of the base bracket 22, 24 that is disposed at a plate portion 58 of the base bracket 22, 24. The engagement portions 56 include respective cylindrical projections 60*a*, 60*b* extending substantially orthogonally from a planar extent of the plate portions 58 (see FIGS. 15A and 15B). At the lower end of the door, a lower support post 62 extends downward from the lower horizontal member 42 of the door bracket 30 for pivotally coupling with an axial or central cavity or opening 64 disposed at or in the cylindrical projection 60*b* of the lower base bracket 24. Further, as shown in FIGS. 11 and 12, a roller bearing 66 may be disposed between the lower support post 62 and the central opening 64 in the cylindrical projection 60*b* of the lower base bracket 24. In one embodiment the roller bearing 66 has a conical shape with cylindrical rollers 66*a* disposed around the conical surface 66*b* to reduce friction at the pivotal connection. It is also conceivable that alternative forms and shapes of bearings and/or lubricants may be disposed at the pivotal connection to reduce friction.

Figure 10:
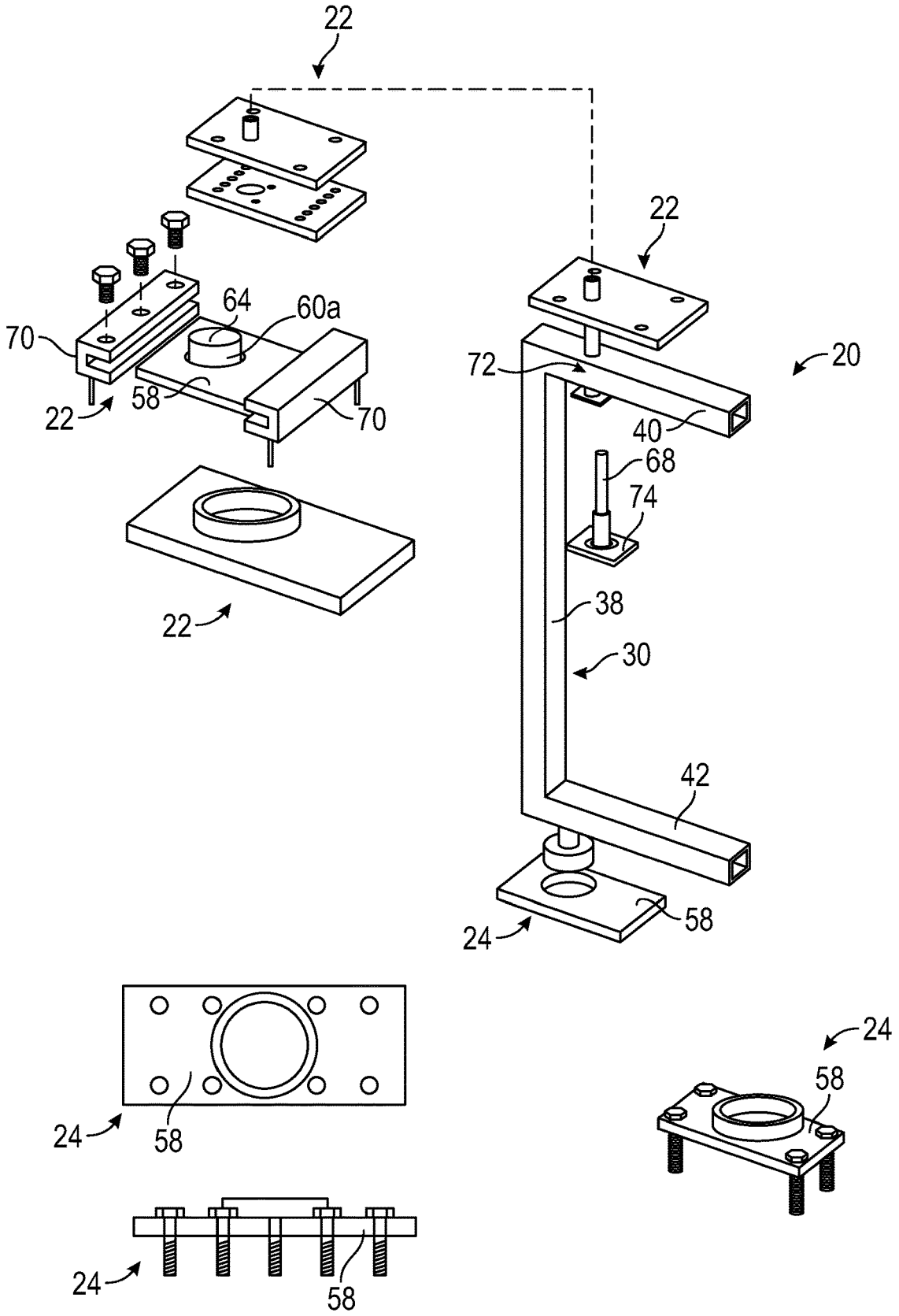
FIG. 10 provides additional perspective and elevational views of the hinge bracket assembly of FIG. 9.

At the upper end of the door, an upper support post 68 may extend upward from the upper horizontal member 40 of the door bracket 30 for pivotally coupling with the axial or central cavity or opening 64 disposed at or in the cylindrical projection 60*a* of the upper base bracket 22. As illustrated in FIG. 10, the plate portion 58 of the upper base bracket 22 may slidably engage opposing channel brackets 70 secured at the structural opening 16. Then, with the plate portion 58 of the upper base bracket 22 engaged with the opposing channel brackets 70, the upper support post 68 is configured to be inserted through an aperture 72 in the upper horizontal member 40 to engage the axial or central opening 64 in the cylindrical projection 60*a* of the upper base bracket 22. The upper support post 68 may have a lower flange 74 that prevents over-insertion and allows for an additional surface for connection at the door bracket 30 by abutting the lower flange 74 at the lower surface of the upper horizontal member 40 and attaching it thereat, such as via fasteners, welding, and/or adhesive or the like. Before or after pivotally engaging the door bracket 30 at the closet opening 16, the closet door module 32 may be engaged with the upper and lower horizontal members 40, 42 of the door bracket 30 to provide the operable door portion that is configured to pivot relative to the closet opening.

Therefore, the closet assembly and associated hinge assembly provide for more efficient space usage in a closet area, and may facilitate or provide additional functionality for a closet area. The hinge assembly is capable of supporting significant loads on the movable operable door portion.

Changes and modifications in the specifically-described embodiments may be carried out without departing from the principles of the present invention, which is intended to be limited only by the scope of the appended claims as interpreted according to the principles of patent law including the doctrine of equivalents.

The invention claimed is:

1. A closet assembly comprising:

a fixed portion configured to be disposed at a structural opening of a closet disposed within a wall, wherein the fixed portion is disposed within the closet;

an operable door portion configured to move relative to the fixed portion between a closed position and an open position, wherein the operable door portion is at least partially positioned within the closet when in the closed position;

a hinge assembly disposed between the operable door portion and the structural opening, wherein the operable door portion moves via the hinge assembly;

wherein the hinge assembly comprises an upper base bracket and a lower base bracket, each having a plate portion and a cylindrical projection extending substantially orthogonal from a planar extent of the plate portion, and wherein the plate portion of the upper base bracket slidably engages opposing channel brackets configured to secure at the structural opening;

wherein the hinge assembly further comprises a door bracket comprising upper and lower horizontal members and a vertical member extending between and coupled to the upper and lower horizontal members; and wherein the upper and lower horizontal members are pivotally coupled with the cylindrical projections of the respective upper and lower base brackets.

2. The closet assembly of claim 1, wherein the operable door portion further comprises an upper channel and a lower channel that engage the respective upper and lower horizontal members of the hinge assembly.

3. The closet assembly of claim 2, wherein the upper and lower horizontal members of the hinge assembly are configured to receive any one of a plurality of closet door modules.

4. The closet assembly of claim 3, wherein the plurality of closet door modules includes at least one of a shelf module, a clothing hanger module, and a wet bar module.

5. The closet assembly of claim 3, wherein a selected module of the plurality of closet modules is configured to engage the upper and lower horizontal members of the hinge assembly to face a functional side of the selected module either toward or away from the fixed portion of the closet door assembly.

6. The closet assembly of claim 1, wherein the fixed portion comprises at least one of a wardrobe cabinet arrangement, a desk cabinet arrangement, and a beverage storage cabinet arrangement.

7. The closet assembly of claim 1, wherein the hinge assembly further comprises an upper support post and a lower support post that extend upward and downward respectively from the upper and lower horizontal members of the door bracket for pivotally coupling with central openings in the cylindrical projections of the respective upper and lower base brackets.

8. The closet assembly of claim 7 further comprising a roller bearing disposed between the lower support post and the central opening in the cylindrical projection of the lower base bracket.

9. The closet assembly of claim 1, wherein, with the plate portion of the upper base bracket engaged with the opposing channel brackets, the upper support post is configured to extend through the upper horizontal member to engage the central opening in the cylindrical projection of the upper base bracket.

* * * * *